US008833021B2

(12) United States Patent
Yen

(10) Patent No.: US 8,833,021 B2
(45) Date of Patent: Sep. 16, 2014

(54) EXTERIOR WALL DECORATIVE FOAM PANEL

(71) Applicant: Mospen Products Company, Taipei (TW)

(72) Inventor: Chason Yen, Taipei (TW)

(73) Assignee: Mospen Products Company, Taipei (TW)

( * ) Notice: Subject to any disclaimer, the term of this patent is extended or adjusted under 35 U.S.C. 154(b) by 0 days.

(21) Appl. No.: 13/762,394

(22) Filed: Feb. 8, 2013

(65) Prior Publication Data

US 2014/0223847 A1 Aug. 14, 2014

(51) Int. Cl.
*E04B 1/70* (2006.01)
*E04F 13/08* (2006.01)

(52) U.S. Cl.
CPC ..... *E04F 13/0869* (2013.01); *E04F 13/0889* (2013.01); *E04F 13/0871* (2013.01)
USPC ..... 52/302.3; 52/483.1

(58) Field of Classification Search
CPC ... E04B 1/7069; E04B 1/7023; E04B 1/7612; E04B 1/7046; E04B 1/703; E04B 2/14; E04B 2/42; E04D 13/0409; E04D 2013/0413; E04D 13/0445; E04D 3/357; E04D 13/0481; E04D 13/1693
USPC ..... 52/302.1, 302.3, 302.4, 220.7, 220.2, 52/779, 220.4, 483.1
See application file for complete search history.

(56) References Cited

U.S. PATENT DOCUMENTS

| | | | | |
|---|---|---|---|---|
| 4,586,304 | A * | 5/1986 | Flamand | 52/309.8 |
| 6,145,261 | A * | 11/2000 | Godfrey et al. | 52/302.1 |
| 6,298,620 | B1 * | 10/2001 | Hatzinikolas | 52/302.1 |
| 7,694,477 | B2 * | 4/2010 | Kuelker | 52/302.3 |
| 7,748,183 | B2 | 7/2010 | Myers et al. | |
| 8,091,313 | B2 * | 1/2012 | Wilson et al. | 52/534 |
| 8,438,806 | B2 * | 5/2013 | Lim | 52/302.1 |
| 8,499,517 | B2 * | 8/2013 | Wilson et al. | 52/519 |
| 8,511,030 | B2 * | 8/2013 | Wilson et al. | 52/519 |
| 8,549,806 | B2 * | 10/2013 | Snyder | 52/302.1 |
| 2003/0056458 | A1 * | 3/2003 | Black et al. | 52/541 |
| 2011/0271622 | A1 * | 11/2011 | Wilson et al. | 52/302.1 |

* cited by examiner

*Primary Examiner* — William Gilbert
*Assistant Examiner* — Gisele Ford
(74) *Attorney, Agent, or Firm* — Leong C. Lei

(57) ABSTRACT

Disclosed is an exterior wall decorative foam panel made of foam and manufactured into a board, and plural decorative exterior wall panels are combined and mounted onto a surface of an interior wall. The exterior wall panel includes a decorative surface, a mounting surface, a plurality of drainage structures, a first embedding slot, a first embedding block, a second embedding slot and a second embedding block. The decorative surface and the mounting surface are disposed on both sides of the board respectively, and the drainage structures are connected adjacent to one another and protruded from the mounting surface. Each drainage structure includes a water collection part and a ditch part assembled into a substantially Y-shape for enhancing the overall strength and providing a good drainage effect.

9 Claims, 8 Drawing Sheets

EXTERIOR WALL DECORATIVE FOAM PANEL

BACKGROUND OF THE INVENTION

1. Field of the Invention

The present invention relates to the technical field of decoration materials for buildings, and more particularly to an exterior wall decorative foam panel made of foam and used for attaching onto a surface of an interior wall.

2. Description of the Related Art

Exterior wall decorative foam originates from the United States, and it is a new construction material used to replace conventional construction materials including wood and anti-corrosive wood. The exterior wall decorative foam has the advantages of corrosion resistance, low maintenance, low deformation, waterproof as well as the anti-mildew, anti-pest, fire retardant and thermal insulation effects. In addition, 100% of the discarded material of the exterior wall decorative foam can be recycled and reused. Thus, the exterior wall decorative foam can meet the requirements of green economy, low-carbon consumption, environmental protection and recycle and reuse, and it gradually becomes a popular material in Europe and the United States.

As disclosed in U.S. Pat. No. 7,748,183 entitled "System, methods and compositions for attaching paneling to a building surface," disclosing the panel has an upper interlocking member and a lower interlocking member disposed at an upper end and a lower end of the panel respectively and a side interlocking member disposed on both sides of the panel separately, wherein the upper interlocking members and the lower interlocking members of two opposite panels and the side interlocking members on both sides are bevels combined by a tongue-and-groove joint with a contact angle of between 22.5 and 77.5 degrees to achieve a tight connection each other. The panel further comprises a plurality of weep channels and a plurality of air chambers formed on the back surface of the panel to achieve the water drainage and air circulation effects.

However, the length of the bevel and the tongue-and-groove joint varies with the contact angle. The smaller the contact angle, the greater is the length of the bevel and the tongue-and-groove joint, and the smaller is the thickness, so that the decorative external wall may be cracked or broken easily during transportation. On the other hand, the greater the contact angle, the smaller is the length of the bevel and the tongue-and-groove joint, so that the interlocking effect may be affected adversely. Thus, the most preferred contact angle is 45 degrees. Since the foam material is porous and has a waterproof effect that does not absorb water as water is stored in the crevices of the panels, therefore the issues of the mildew, fouling and moss may arise. Although the panel comes with the design of the weep channels, the foregoing issues still exists because the aspect ratio of the panel is a too-large, so that it is necessary to increase the thickness of the material or add a reinforcing material to enhance the overall strength. The increased thickness results in an increased depth of the air chambers and an uneasy drainage. Further, the increased thickness also causes an increase of weight and incurs a higher cost. Obviously, the conventional exterior wall decorative foam panel requires improvements.

SUMMARY OF THE INVENTION

In view of the aforementioned problems of the prior art, it is a primary objective of the present invention to overcome the problems by providing an exterior wall decorative foam panel which comprises a plurality of drainage structures protruded from a mounting surface of the exterior wall decorative foam panel and connected adjacent to one another, and each drainage structure includes a water collection part and a groove in a substantially Y-shape for collecting and guiding water effectively and discharging the water from the groove to maintain most areas of the mounting surface dry, so as to prevent mildew and moss and extend service life.

Another objective of the present invention is to provide an exterior wall decorative foam panel, wherein the drainage structures arranged adjacent to one another are used, and the design of a reinforcing mesh is added in the manufacturing process, so that the overall strength can be enhanced without increasing the thickness.

A further objective of the present invention is to provide an exterior wall decorative foam panel comprising a first embedding block, a first embedding slot, a second embedding block and a second embedding slot formed at the periphery of the wall panel and fixed with one another by embodiment. In addition, the first embedding block and the second embedding block have a first bevel and a second bevel inserted into the first embedding slot and the second embedding slot respectively to achieve the guiding effect and aligning the surfaces evenly, so as to improve the convenience of construction and the appearance of the building.

To achieve the aforementioned objective, the present invention provides an exterior wall decorative foam panel made of foam and integrally formed into a rectangular board, and plural exterior wall decorative foams are combined and mounted onto a surface of an interior wall, and the exterior wall decorative foam panel comprises: a decorative surface disposed on a first side of the board and having a plurality of bumps and a plurality of grooves formed with an interval apart from one another; a mounting surface disposed on a second side of the board for setting on a surface of the interior wall; a plurality of drainage structures protruded from the mounting surface and arranged adjacent to one another, and each drainage structure including a water collection part and a ditch part, and the water collection part having an opening that is substantially V-shaped, and the ditch part being disposed at an opening/closing position of the water collection part and making the drainage structure in the substantially Y-shape, and a portion of the mounting surface without the drainage structures being a dry area; a first embedding slot formed at a first short-side edges of the board; a first embedding block disposed at a second short-side edge of the board, and the two opposite boards being assembled at the short side, such that the first embedding block can be inserted into the first embedding slot; a second embedding slot formed at a first long-side edges of the board; and a second embedding block disposed at a second long-side edge of the board, and the two opposite boards are assembled along the long side, so that the second embedding block can be inserted into the second embedding slot.

Wherein, each bump has an appearance of a rock or a brick to improve the appearance of the exterior wall decorative foam panel.

Wherein, a total area of the water collection parts equals to 10%~25% of a total area of the mounting surface, so that the chance of the mounting surface being in contact with water can be reduced. In addition, the drainage structure further includes a waterproof coating capable of reducing the chance of absorbing water by the foam, so as to prevent mildew and moss and extend service life effectively.

To enhance the overall strength, the exterior wall decorative foam panel of the present invention further comprises a reinforcing mesh included in the board during the manufacturing process and integrally formed with the board after the reinforcing mesh is dried and shaped, and the reinforcing mesh provides an adhesive force of the foam to achieve the effect of enhancing the overall strength.

Wherein, the first embedding block has a first bevel disposed on a side opposite to the mounting surface, and the second embedding block has a second bevel disposed on a side opposite to the mounting surface. In addition, the first bevel is gradually tilted from the board towards an edge, and the second bevel is gradually tilted from the board towards an edge. The first bevel has a length corresponding to the depth of the first embedding slot, and the second bevel has a length corresponding to the depth of the second embedding slot. Therefore, the guiding function provided for the installation enhances the convenience of construction and aligns the surfaces of the wall panels evenly to improve the appearance of the construction.

Wherein, the water collection part has a predetermined angle falling within a range of 30~120 degrees and preferably equal to 90 degrees for collecting the intake water effectively, and the predetermined angle makes the water flow smoother and facilitates discharging water.

DETAILED DESCRIPTION OF THE PREFERRED EMBODIMENTS

The technical content of the present invention will become apparent with the detailed description of preferred embodiments and the illustration of related drawings as follows.

Figure 1:
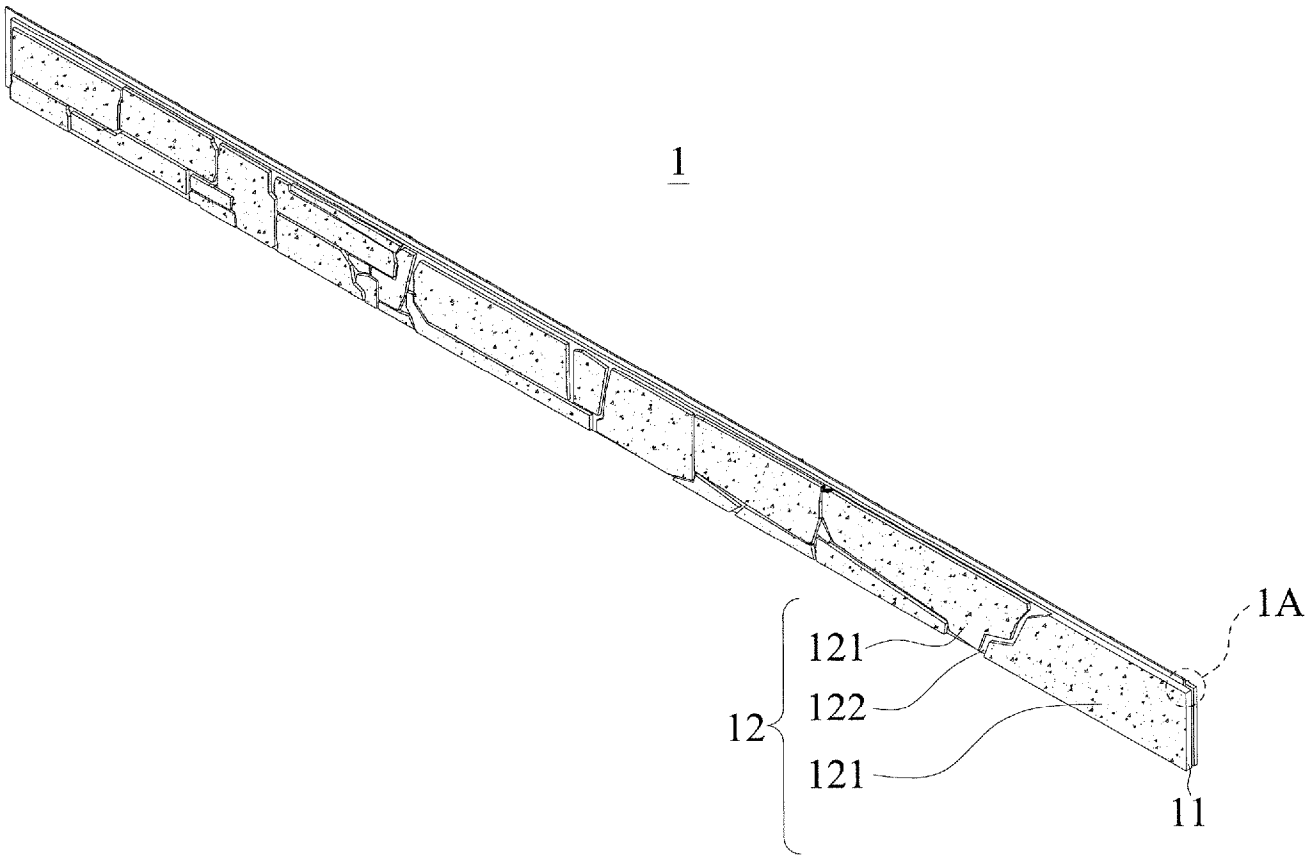
FIG. 1 is a schematic front view of an assembly of a preferred embodiment of the present invention.
Figure 1A:
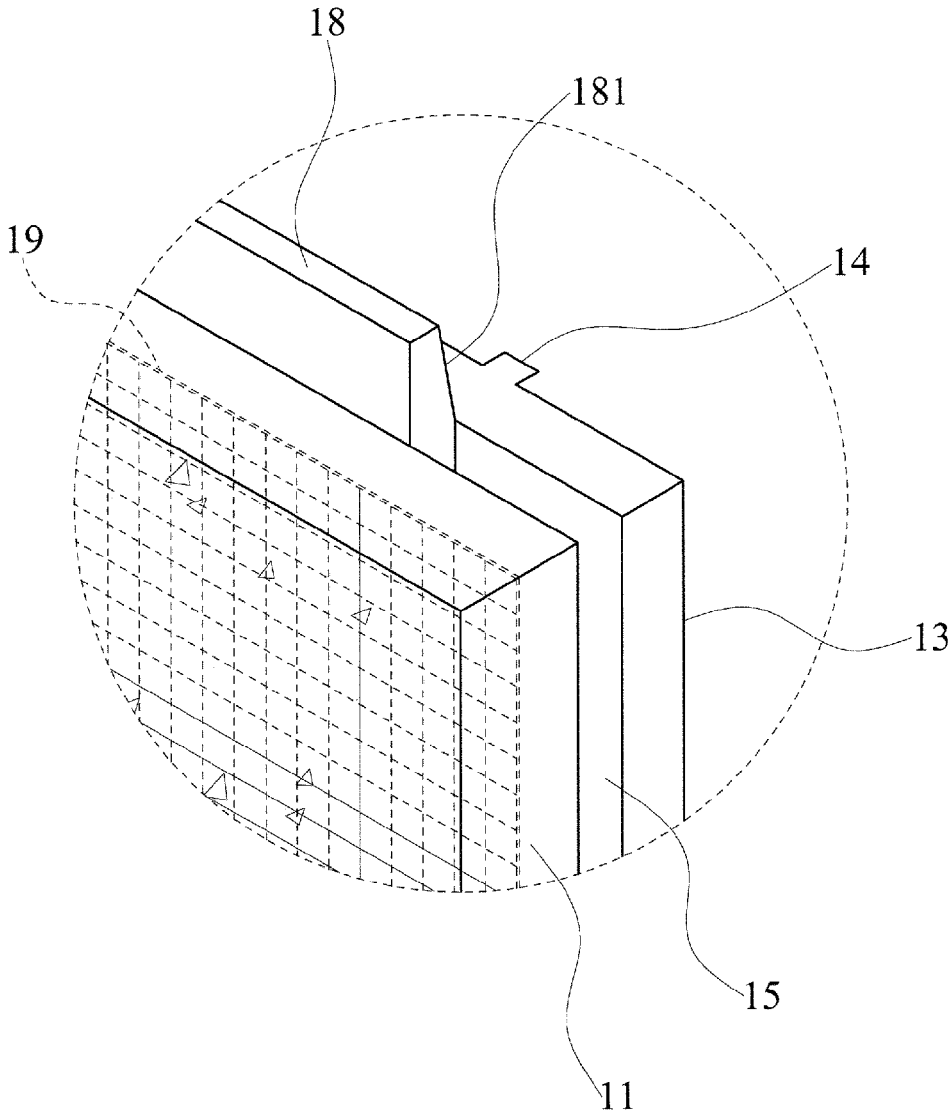
FIG. 1A is an enlarged view of portion "1A" of FIG. 1.
Figure 2:
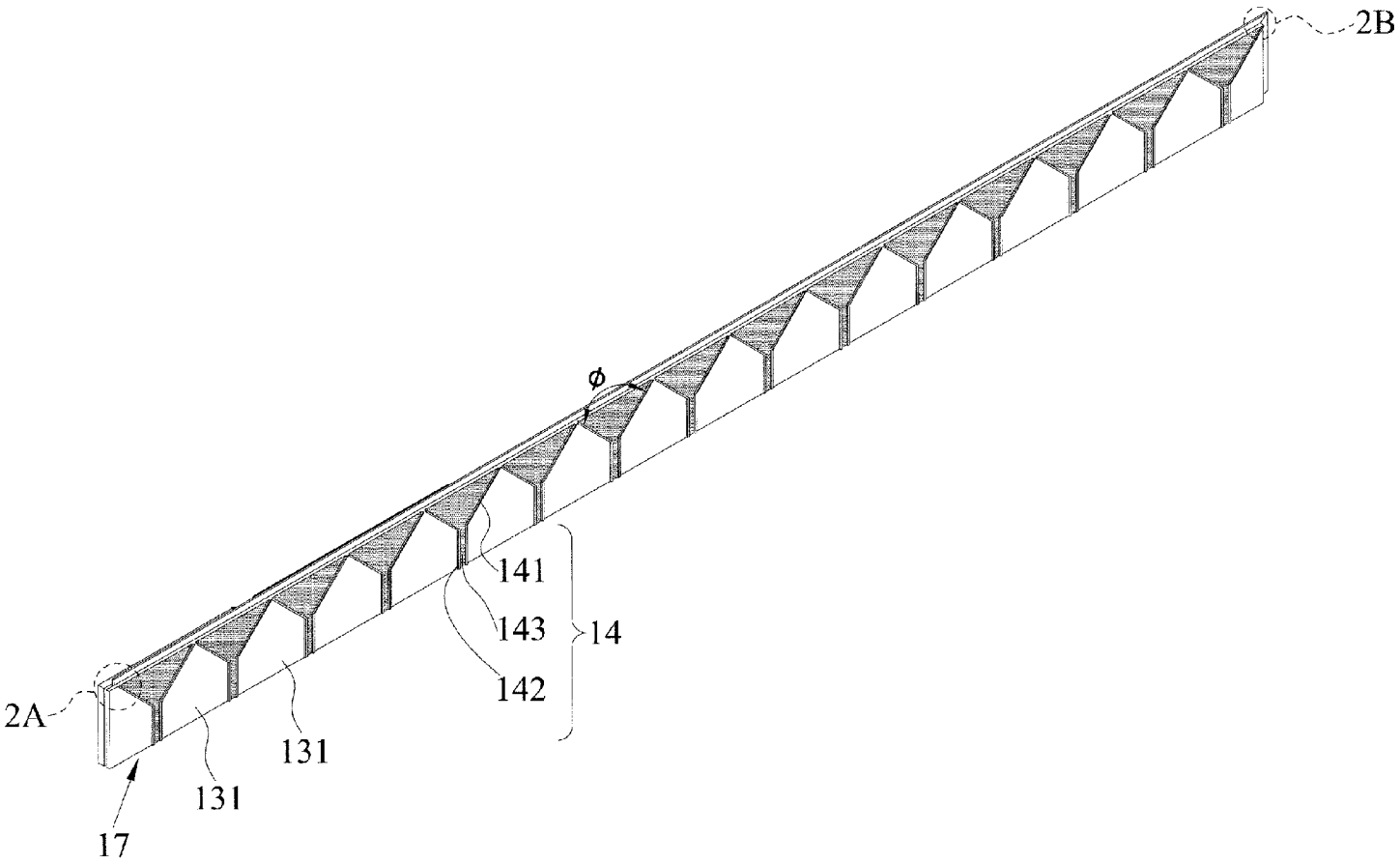
FIG. 2 is a schematic back view of an assembly of a preferred embodiment of the present invention.
Figure 2A:
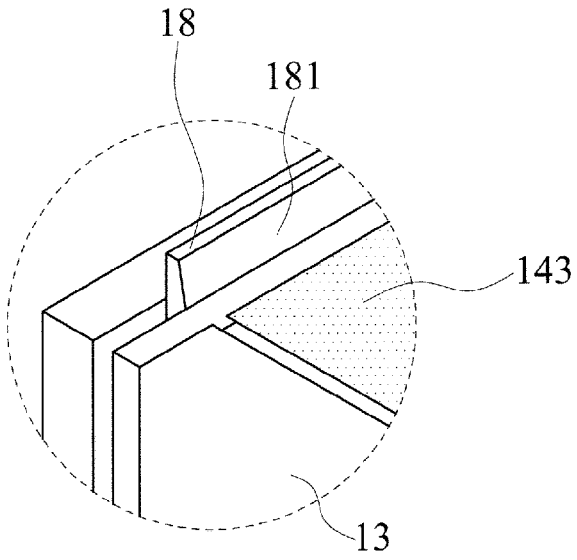
FIG. 2A is an enlarged view of portion "2A" of FIG. 2.
Figure 2B:
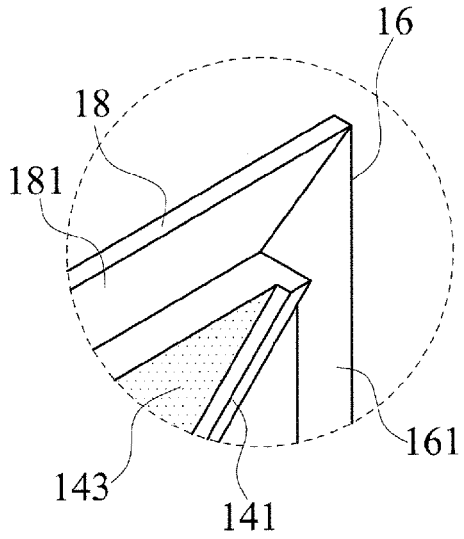
FIG. 2B is an enlarged view of portion "2B" of FIG. 2.
Figure 3:
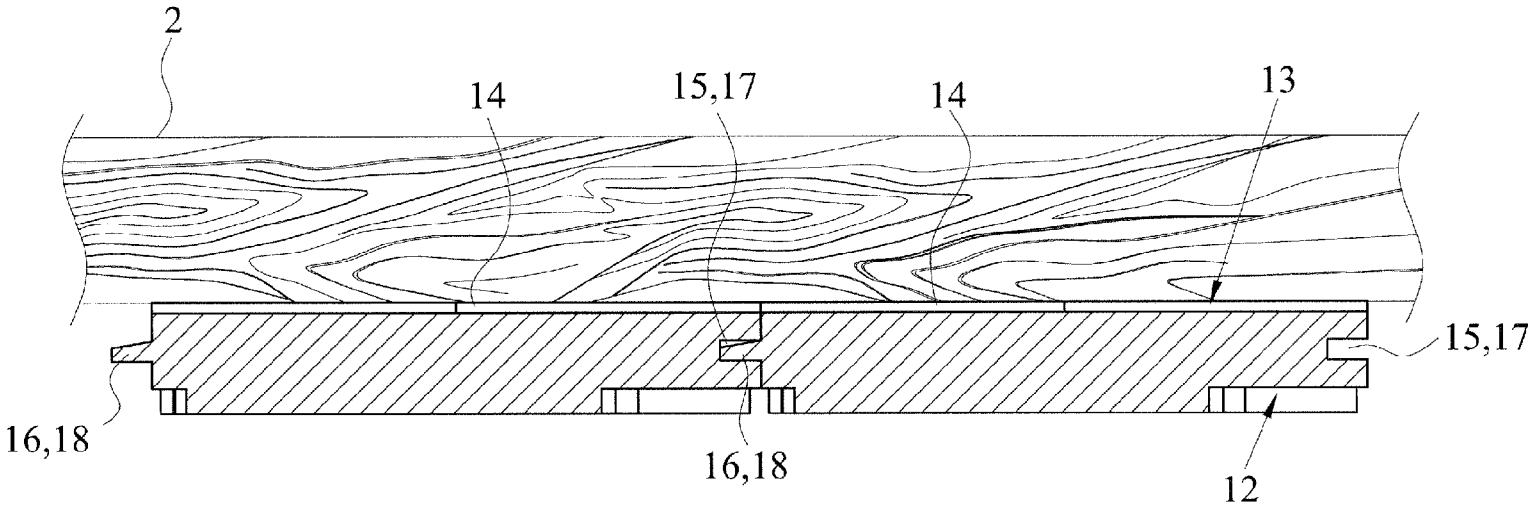
FIG. 3 is a cross-sectional view of an assembly of a preferred embodiment of the present invention.
Figure 4:
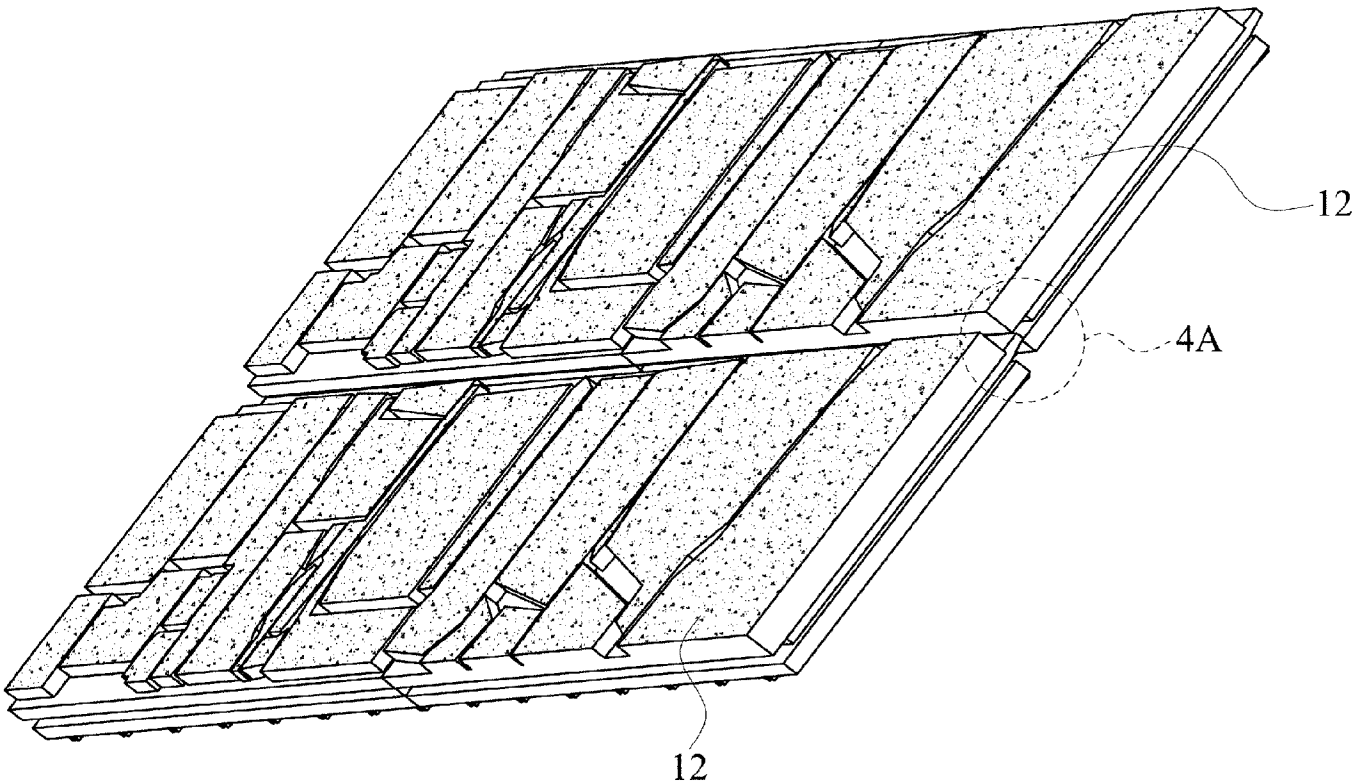
FIG. 4 is a first schematic view of an installing status of a preferred embodiment of the present invention.
Figure 4A:
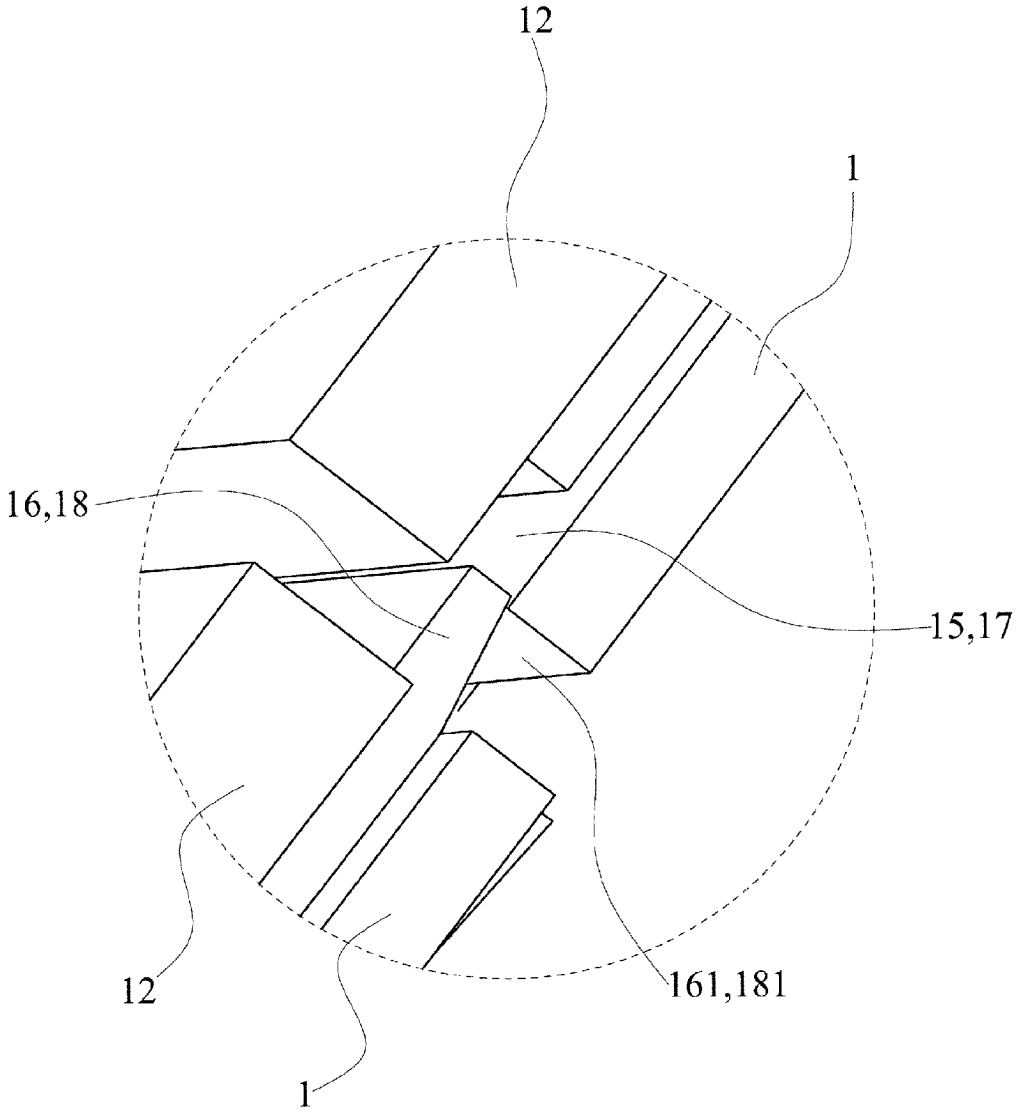
FIG. 4A is an enlarged view of portion "4A" of FIG. 4.
Figure 5:
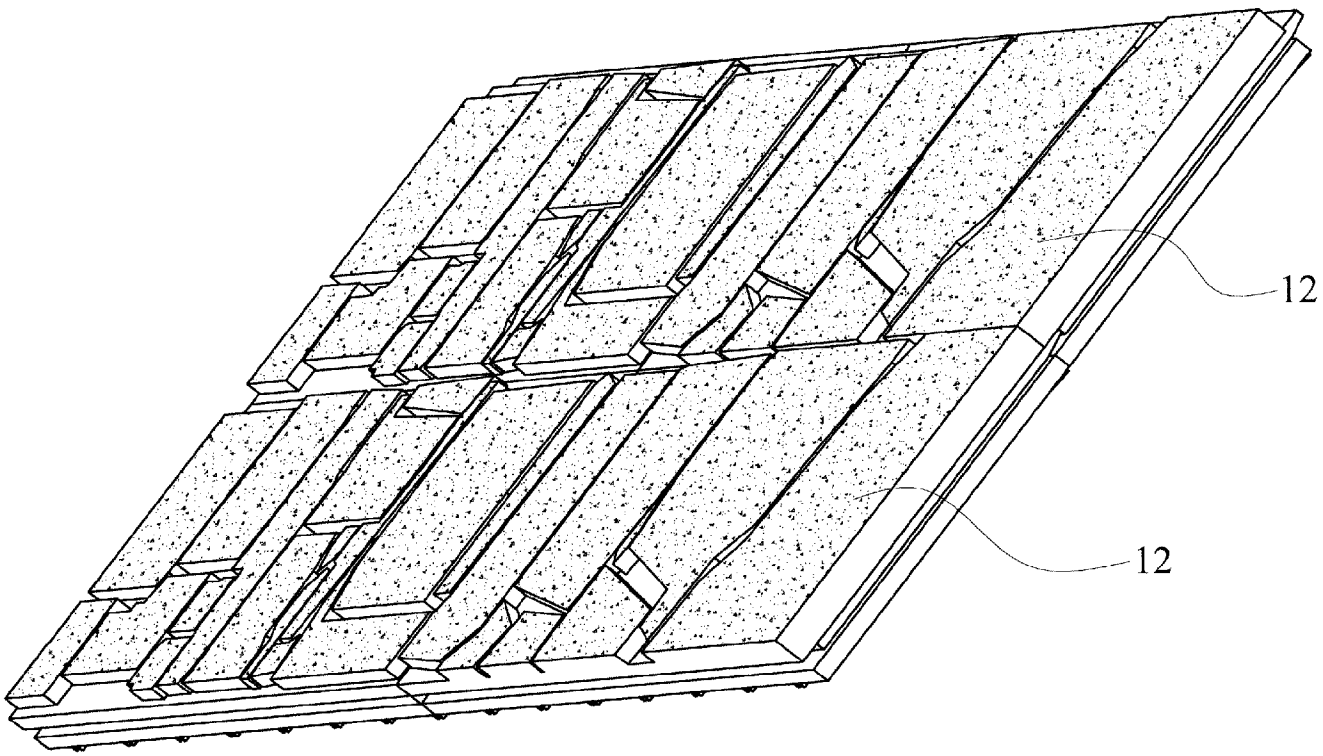
FIG. 5 is a second schematic view of an installing status of a preferred embodiment of the present invention.

With reference to FIGS. 1 to 5 for a front view, a rear view, enlarged view and a cross-sectional view of an assembly and schematic views of different installing statuses in accordance with a preferred embodiment of the present invention respectively, an exterior wall decorative foam panel 1 of the present invention is made of foam and integrally formed into a board 11 which is substantially in a rectangular shape, and plural exterior wall decorative foam panels 1 can be combined and mounted onto a surface of an interior wall 2. The exterior wall decorative foam panel 1 comprises a decorative surface 12, a mounting surface 13, a plurality of drainage structures 14, a first embedding slot 15, a first embedding block 16, a second embedding slot 17 and a second embedding block 18.

The decorative surface 12 is formed on a first side of the board 11, and the decorative surface 12 has a plurality of bumps 121 and a plurality of grooves 122 arranged with an interval apart from one another, wherein each of the bump 121 is manufactured with an appearance of a rock or a brick to give a decorative effect similar to a rock or brick wall to the interior wall 2.

The mounting surface 13 is disposed on a second side of the board 11. In general, the board 11 is nailed onto a surface of the interior wall 2, so that the mounting surface 13 is engaged with a surface of the interior wall 2.

The drainage structures 14 are protruded from the mounting surface 13, so that after the board 11 is mounted onto the surface of the interior wall 2, the drainage structures 14 form sealed spaces respectively, and the drainage structures 14 are connected adjacent to one another, and each drainage structure 14 includes a water collection part 141 and a ditch part 142. The water collection part 141 is disposed at an upper section of the mounting surface 13, and the water collection part 141 has a substantially V-shaped opening, and the water collection part 141 has a predetermined angle ø falling within a range of 30~120 degrees and preferably equal to 90 degrees. The ditch part 142 is disposed at an opening/closing position of the water collection part 141 to make the drainage structure 14 in a substantially Y-shape. A dry area 131 is disposed at a portion of the mounting surface 13 without the drainage structures 14. It is noteworthy that a waterproof coating 143 is coated onto an area of each drainage structure 14 that includes the water collection part 141 and the ditch part 142 to enhance the waterproof effect, so that water will not overflow into the dry area 131. In addition, the water collection parts 141 of the present invention have a total area equal to 10%~25% of the total area of the mounting surface 13 to reduce the chance of the mounting surface 13 being in contact with water.

The first embedding slot 15 is extended and disposed on a first short-side edge of the board 11, and the first embedding slot 15 is a groove inwardly and concavely formed on a surface.

The first embedding block 16 is extended and disposed on a second short-side edge of the board 11. When the two opposite boards 11 are assembled along the short side, the first embedding block 16 is inserted into the first embedding slot 15. It is noteworthy that the first embedding block 16 has a first bevel 161 disposed on a side opposite to the mounting surface 13 to facilitate the installation, and the first bevel 161 is tilted gradually from the board 11 towards an edge to provide a guiding function for the installation, and the first bevel 161 has a first length corresponding to the depth of the first embedding slot 15. After the first embedding block 16 is inserted, the first embedding block 16 gradually pushes a short side of the board 11 until the first embedding block 16 is completely inserted, so that the decorative surfaces 12 of the two boards 11 are aligned evenly.

The second embedding slot 17 is extended and disposed at a first long-side edge of the board 11, and the second embedding slot 17 is a groove inwardly and concavely formed on a surface.

The second embedding block 18 is extended and disposed at a second long-side edge of the board 11, and the installation method is similar to the installation of the first embedding block 16 and the first embedding slot 15 and thus will not be repeated. To facilitate the installation, the second embedding block 18 has a second bevel 181 disposed on a side opposite to the mounting surface 13, and the second bevel 181 is gradually tilted from the board 11 towards an edge to provide a guiding function for the installation. The second bevel 161 has a second length corresponding to the depth of the second embedding slot 17. After the second embedding block 18 is inserted, the board 11 gradually pushes a long side of the board 11 until the second embedding block 18 is completely inserted, so that the decorative surfaces 12 of the two boards 11 are aligned evenly.

In addition, the exterior wall decorative foam panel 1 of the present invention further comprises a reinforcing mesh 19 for enhancing the strength of the wall panel during the process of integrally forming the board 11.

What is claimed is:

1. An exterior wall decorative foam panel, made of foam and integrally formed into a board, and the board being substantially in a rectangular shape, and plural exterior wall decorative foams being combined and mounted onto a surface of an interior wall, and the exterior wall decorative foam panel comprising:

a decorative surface, disposed on a first side of the board, and the decorative surface having a plurality of bumps and a plurality of grooves formed with an interval apart from one another; a mounting surface, disposed on a second side of the board, for attaching on the surface of the interior wall;

a plurality of drainage structures, indented relative to the mounting surface and arranged adjacent to one another, and each of the plurality of drainage structures including a water collection part and a ditch part, and the water collection part having an opening that is substantially funnel shaped and has an indented cross sectional width that is substantially larger than that of the ditch part, the funnel shaped opening of the water collection part has a predetermined angle falling within a range of 30-120 degrees, and the ditch part being disposed at an opening/closing position of the water collection part, and a portion of the mounting surface without the drainage structures being a dry area, wherein the water collection part is disposed at an upper boarder of the mounting surface, wherein a total area of the water collection parts equals to 10%~25% of the total area of the mounting surface;

a first embedding slot, formed at a first short-side edge of the board;

a first embedding block, formed at a second short-side edge of the board, and when two opposite pieces of the boards being assembled by the first short-side edge and the second short-side edge respectively, such that the first embedding block can be inserted into the first embedding slot;

a second embedding slot, formed at a first long-side edges of the board; and a second embedding block, formed at a second long-side edge of the board, and when two opposite pieces of the boards being assembled by the first long-side edge and the second long-side edge respectively, so that the second embedding block can be inserted into the second embedding slot.

2. The exterior wall decorative foam panel of claim 1, wherein each bump has an appearance of a rock or a brick.

3. The exterior wall decorative foam panel of claim 1, further comprising a waterproof coating coated onto the drainage structures.

4. The exterior wall decorative foam panel of claim 1, further comprising a waterproof coating coated onto the drainage structures.

5. The exterior wall decorative foam panel of claim 4, further comprising a reinforcing mesh included inside the board.

6. The exterior wall decorative foam panel of claim 5, wherein the reinforcing mesh is integrally formed with the board and disposed therein for enhancing the strength of the board.

7. The exterior wall decorative foam panel of claim 6, wherein the first embedding block has a first bevel disposed on a side opposite to the mounting surface, and the second embedding block has a second bevel disposed on the side opposite to the mounting surface.

8. The exterior wall decorative foam panel of claim 7, wherein the first bevel is gradually tilted from the board towards an edge, and the second bevel is gradually tilted from the board towards the edge.

9. The exterior wall decorative foam panel of claim 8, wherein the first bevel has a first length corresponding to the depth of the first embedding slot, and the second bevel has a second length corresponding to the depth of the second embedding slot.

* * * * *